US007124827B2

(12) United States Patent
Braddick

(10) Patent No.: US 7,124,827 B2
(45) Date of Patent: Oct. 24, 2006

(54) EXPANDABLE WHIPSTOCK ANCHOR ASSEMBLY

(75) Inventor: Britt O. Braddick, Houston, TX (US)

(73) Assignee: TIW Corporation, Houston, TX (US)

( * ) Notice: Subject to any disclaimer, the term of this patent is extended or adjusted under 35 U.S.C. 154(b) by 240 days.

(21) Appl. No.: 10/919,702

(22) Filed: Aug. 17, 2004

(65) Prior Publication Data

US 2006/0037759 A1 Feb. 23, 2006

(51) Int. Cl.
*E21B 19/16* (2006.01)

(52) U.S. Cl. ..... 166/380; 166/117.6

(58) Field of Classification Search ..... 166/380, 166/384, 117.5, 117.6, 207
See application file for complete search history.

(56) References Cited

U.S. PATENT DOCUMENTS

| | | | | |
|---|---|---|---|---|
| 4,285,399 | A | 8/1981 | Holland et al. | |
| 5,398,754 | A | 3/1995 | Dinhoble | |
| 5,566,762 | A | 10/1996 | Braddick | |
| 5,595,247 | A | 1/1997 | Braddick | |
| 5,647,437 | A | 7/1997 | Braddick et al. | |
| 6,360,821 | B1 | 3/2002 | Braddick | |
| 6,488,095 | B1 | 12/2002 | Buytaert | |
| 6,543,536 | B1 * | 4/2003 | Dewey et al. | 166/255.2 |
| 6,749,026 | B1 * | 6/2004 | Smith et al. | 166/313 |
| 6,968,896 | B1 * | 11/2005 | Coon | 166/117.6 |
| 7,017,668 | B1 * | 3/2006 | Smith et al. | 166/380 |
| 2002/0000319 | A1 * | 1/2002 | Brunet | 166/313 |
| 2005/0178555 | A1 * | 8/2005 | Smith et al. | 166/313 |

FOREIGN PATENT DOCUMENTS

| | | |
|---|---|---|
| EP | 1172520 A3 | 1/2002 |
| GB | 2334734 | 9/1999 |
| GB | 2388138 | 11/2003 |

* cited by examiner

*Primary Examiner*—William Neuder
(74) *Attorney, Agent, or Firm*—Browning Bushman P.C.

(57) ABSTRACT

A whipstock assembly includes a tubular anchor 36 which is expanded into engagement with the casing string 8, and a tubular expander 24 which is forcibly moved into the tubular anchor to expand the tubular anchor downhole into secure engagement with the casing string. The tubular anchor and tubular expander remain downhole. An orientation sleeve 18 at the upper end of the expander 24 includes an orientation surface 20. A whipstock 70 engages the sleeve 18 to orient the whipstock face for diverting a tool into a hole in the side of the casing string. Once the whipstock 70 is removed from the well, the orientation sleeve may receive a sealing nipple 130 at the lower end of a production tubing string.

21 Claims, 4 Drawing Sheets

EXPANDABLE WHIPSTOCK ANCHOR ASSEMBLY

FIELD OF THE INVENTION

The present invention relates to a downhole whipstock assembly which conventionally diverts a tool to drill a hole into a casing string or diverts a tool into a hole in the side of a casing string. More particularly, this invention relates to an expandable whipstock anchor for sealingly engaging the casing string to support the whipstock thereon.

BACKGROUND OF THE INVENTION

A whipstock is a tool inserted in the wellbore to deflect a mill, drill bit or other tools in a direction that is angularly offset from the orientation of the original wellbore. The face of the whipstock is thus oriented at a selected directional azimuth relative to the borehole axis. One type of whipstock is disclosed in U.S. Pat. No. 4,285,399.

At various times, oil well operators are desirous of specialty whipstock assemblies which achieve particular purposes. U.S. Pat. Nos. 5,398,754 and 5,595,247 disclose retrievable whipstock assemblies. U.S. Pat. No. 5,566,762 discloses a through tubing whipstock assembly. A whipstock assembly with a spring biased reference sleeve is disclosed in U.S. Pat. No. 6,488,295.

The prior art provides reliable whipstock assemblies for many applications, but commonly accepted whipstock assemblies, and particularly whipstock anchors, are complex with numerous moving parts. Other whipstock assemblies are comparatively simple, but tend to break loose from the casing string when high forces are transmitted to the whipstock assembly. Still other whipstock assemblies have a significantly reduced diameter bore through the whipstock anchor. When the whipstock is retrieved from the set anchor, tools cannot be reliably passed through the anchor due to the restricted diameter bore.

The disadvantages of the prior art are overcome by the present invention, and an improved whipstock anchor assembly is hereinafter disclosed.

SUMMARY OF THE INVENTION

A whipstock assembly for use downhole in a wellbore seals with the casing string and diverts a tool to mill a hole in the side of the casing string, or to divert a tool into the milled hole. The whipstock assembly comprises a tubular anchor that is supported on a running tool, with the tubular anchor being expandable by the running tool to seal with the casing string. A tubular expander is also removably supported on the running tool, and has an outermost diameter greater than an initial diameter of the tubular anchor. The running tool includes an actuator for forcibly moving the tubular expander axially to a position substantially axially spaced from the tubular anchor to a position substantially within the tubular anchor, thereby expanding the tubular anchor against the casing string. The tubular expander and the tubular anchor remain downhole when the running tool is retrieved. A whipstock is subsequently lowered for engagement with the tubular expander and the whipstock face oriented for diverting the milling tool into the side of the casing, or to divert a tool into the milled hole.

A feature of the invention is that the tubular expander includes an upwardly facing orientation sleeve having an upper orientation surface for engagement with the whipstock. The whipstock face is diverted to a selected azimuth by the orientation sleeve. The whipstock is removable from engagement with the orientation sleeve, which may include an inner bore for subsequently sealing with a tubular string extending upward from the orientation sleeve.

As a further feature of the invention, the lower end of the running tool engages the tubular anchor to restrict axial movement of the tubular anchor when the tubular expander is axially moved into the tubular anchor. The tubular expander preferably is sealed in the tubular anchor by a plurality of annular bumps on the outer surface of the tubular expander, and has a generally cylindrical exterior surface along the axial length of the tubular expander, such that the tubular anchor is expanded uniformly along the axially length of the tubular expander. A stop on the tubular anchor preferably limits axial movement of the tubular expander with respect to the tubular anchor.

The tubular anchor may include one or more packer seals for sealing with the casing string upon expansion of the tubular anchor, and a plurality of slips each fixed to the tubular anchor for securing the tubular anchor to the casing string when the tubular anchor is expanded by the tubular expander.

A further feature of the invention is that the tubular anchor includes a large diameter central bore, thereby allowing for the passage of relatively large tools through the bore of the set anchor.

These and further features and advantages of the present invention will become apparent from the following detailed description, wherein reference is made to the figures in the accompanying drawings.

DETAILED DESCRIPTION OF PREFERRED EMBODIMENTS

Figure 1A:
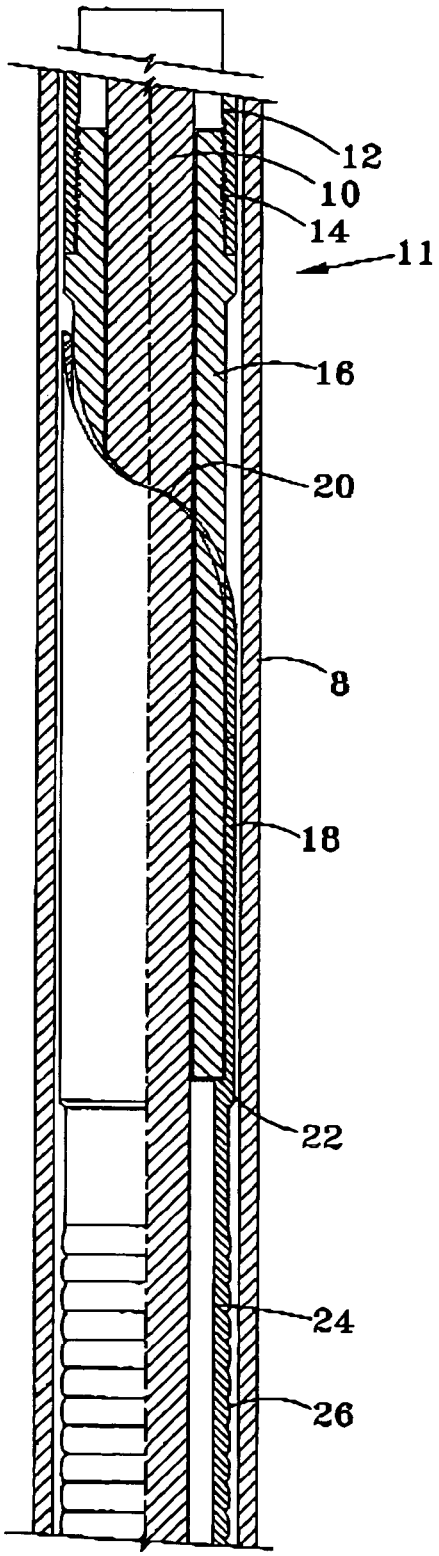
FIG. 1A is a half-sectional view of a tubular expander and an orientation sleeve, with a running tool actuator shown above the orientation sleeve.

A running or setting tool of the present invention may be lowered into a well containing a casing string 8 via a drill pipe or a work string (not shown). The upper end of the setting tool includes a hydraulically powered actuator, generally shown in FIG. 1A as actuator 11, which forcibly moves the tubular expander 24 within the tubular anchor 32, thereby setting the tubular anchor in the casing 8, as explained subsequently. The actuator 11 may consist of a plurality of pistons selected to apply a desired setting force when fluid pressure is increased in the work string. Further information regarding a suitable actuator 11 is disclosed in U.S. Pat. No. 6,622,789, hereby incorporated by reference.

The hydraulically powered actuator 11 effectively moves sleeve 12 downward, while simultaneously moving the inner mandrel 10 upward. The sleeve 12 is connected by threads 14 to a force transfer sleeve 16, which is positioned within orientation sleeve 18 at the upper end of expander 24 when the assembly is run in the well. The force transfer sleeve 16 engages the shoulder 22 at the lower end of the orientation sleeve 18, and thus exerts a downward force on the tubular expander 24 when the actuator 11 is powered. An orientation surface 20 at the upper end of the sleeve 18 is discussed subsequently.

Expander sleeve 24 includes a plurality of bumps on the exterior surface of the expander sleeve. The scallops, circular arcs or circular bumps 26 on the outside of the expander sleeve 24 form a series of metal-to-metal ball seals that provide a gas tight seal between the set expander 24 and the set anchor 32. The tubular expander preferably is a continuous sleeve-shaped member which radially supports the anchor along its full circumference once expanded. The OD and ID of the expander is substantially constant along its length (except for the annular bumps) thereby reducing the likelihood that the expander will slide out from under the set anchor after the running tool is retrieved to the surface. Since the expander sleeve 24 has a generally cylindrical exterior surface along substantially the axial length of the expander, the tubular anchor is expanded substantially the same amount along the axial length of the expander within the set anchor, rather than concentrating the expansion force on the first engaging edge of a tapered expander.

The running tool carries a tubular anchor 32 and a tubular expander 24 preferably positioned above the tubular anchor when run in the well. The tubular expander has an expander outer diameter greater than the anchor inner diameter, such that moving the tubular expander into the anchor will expand the anchor against the casing string to seal the anchor with the casing string and secure the anchor and the tubular expander downhole in the casing string. The tubular expander may be positioned above and rest on the anchor prior to expansion, thereby restraining axially downward movement of the tubular expander. The tubular anchor and expander are preferably solid rather than perforated or slotted.

The anchor 32 is a tubular member preferably having elastomer, graphite or other suitable sealing elements 36 affixed about its outer circumference for sealing with the casing upon expansion of the anchor. A plurality of gripping members, such as slips 34, may be fixed on the tubular anchor for securing the anchor to the casing string upon expansion. The upper internal diameter of the anchor provides an expansion receptacle for receiving the tubular expander 24.

The upper end of the anchor has an inwardly facing taper or incline 28 that provides for overlapping internal engagement of a mating taper 30 on the bottom of the tubular expander 24. This allows the tapered end of the tubular expander to be at least partially inserted into an upper end of the anchor prior to expansion of the tubular anchor. Downward movement of tubular expander 24 within the anchor 32 is prohibited when shoulder on the lower end of expansion sleeve (see FIG. 2A) engages stop surface 38 on the anchor 32. This engagement at the completion of the radial expansion process causing a spike in setting pressure as an indicator at the surface of completion of the expansion process.

The sleeve-shaped expander sleeve thus provides substantial radial support to the tubular anchor once the running tool is returned to the surface. This increased radial support to the anchor also maintains fluid tight engagement between the anchor and casing string. The running tool may then be retrieved with the expander sleeve positioned radially inward of and axially aligned with the anchor to maintain the anchor in gripping engagement with the casing string.

Figure 1B:
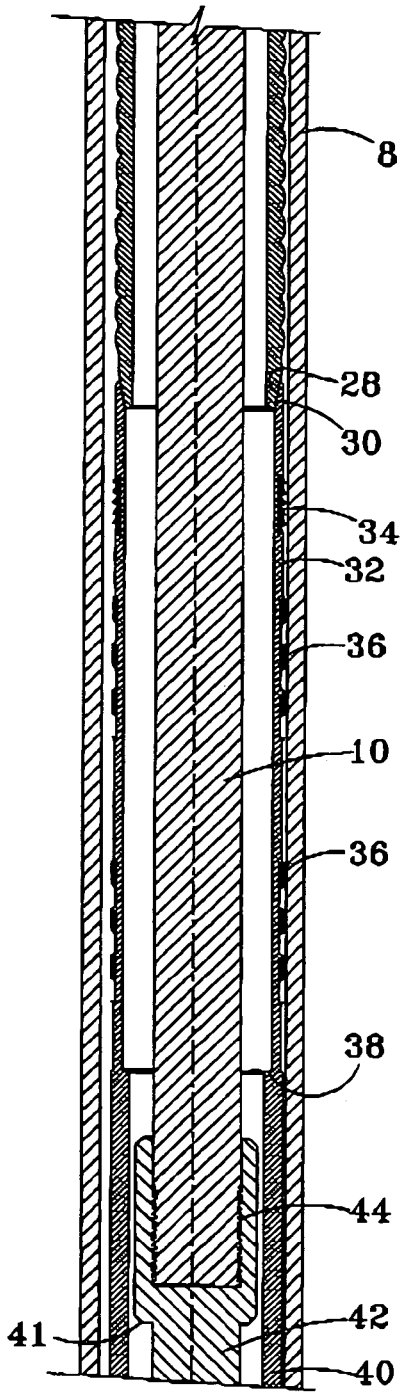
FIG. 1B is a cross-sectional view of a lower portion of the tubular expander and a tubular anchor.
Figure 1C:
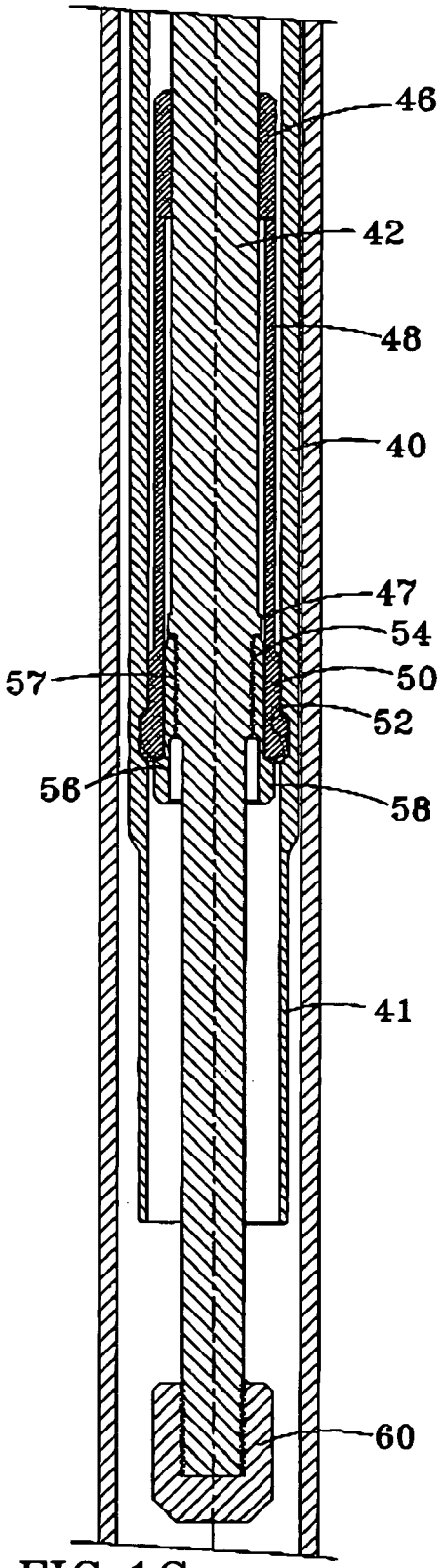
FIG. 1C is a cross-sectional view of the lower portion of the running tool with a tool releasing mechanism.

As shown in FIG. 1B, the mandrel 10 is connected to a lower mandrel extension 42 by a coupling which includes threads 44. FIG. 1B also depicts a elongate extension sleeve 40 below the shoulder 38 on the anchor 32, with the extension sleeve 40 having a relatively thick body for resisting the upward force of a hydraulic actuator 11 on the mandrel 10, as explained subsequently. A lower tubular sleeve 41 below extension sleeve 40 as shown in FIG. 1C has a relatively thin wall, and may function to allow another tubular to be threaded or otherwise connected thereto, with the other tubular then extending downward from the running tool in the well.

An annular groove 52 is provided in the relatively thick sleeve 40. As shown in FIG. 1C, the lower end of the running tool thus engages a component integral with the tubular anchor while the expander 24 is pushed downward into the tubular anchor 32.

The hydraulic running tool may be connected to recess or annular groove 52 in the anchor by releasable collect fingers 48. The collect fingers extend downward from collect ring 46 which is supported on running tool mandrel 10. In the running and setting position, the collect finger heads 50 are prevented from flexing inwardly by the releasing nut 58 that is connected to mandrel extension 42 by a left hand thread. It should be remembered that the mandrel of the running tool moves in an upward direction during setting of the anchor.

After setting the tubular expander 24 within the tubular anchor 32, the actuator assembly of the running tool may be removed by unthreading the threaded connection 57. The left-hand threaded connection 57 prevents undesirable unthreading of the tubular right-hand connections, which typically join tubulars and threaded components of downhole tools. The nut 58 is then free to fall from its position supporting the inner surface of the collect heads 50, and is caught on coupling 60. Ring 46 may engage stop 47, and proceed upward with the stop 47 axially secured to the mandrel extension 42. Upward force applied to the collect ring causes the collect fingers 50 to flex inwardly moving the collect fingers from engagement with the annular recess or slot 52 in the anchor. The running tool is then free to be removed from the set anchor.

As an alternative to unthreading the nut 58, a substantial upward force may be applied by the hydraulic setting tool to the mandrel to shear the nut beneath the threads 57, thereby allowing the lower half of the nut 58 to drop on the coupling 60, while the upper portion 54 of the nut remains threaded to the mandrel extension and may move upward with the mandrel extension 42.

Figure 2A:
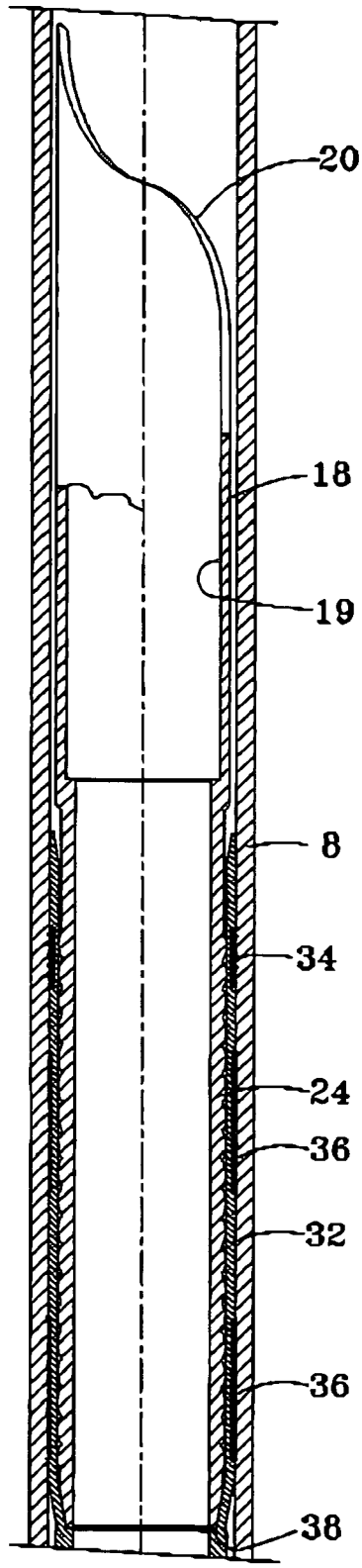
FIG. 2A is a cross-sectional view of the tubular expander positioned within the tubular anchor.

FIG. 2A shows the expander 24 radially within the anchor 32, thereby expanding the anchor 32 into gripping engagement with the casing 8. The running or setting tool has been removed, thereby leaving the set anchor and the expander in the well.

The upper end of the expander 24 has an upward facing orientation sleeve 18 with an internal sealing surface suitable for receiving a tie-back seal nipple after the whipstock is removed from the well. The lower portion of the tubular expander 24 may thus be positioned within the anchor 32 to expand the anchor, while the upper orientation sleeve 18 integral with the tubular expander has an upper orientation surface 20 for orienting the whipstock to the desired azimuth. Before running the whipstock in the well, a conventional survey tool (not shown) may be used to determine the azimuth of the slot in the expander on the set anchor and thus the set orientation sleeve. A whipstock may then be adjusted and run in the well with its face at a desired azimuth in the well when oriented by sleeve 18. The whipstock may be sealed to the sleeve 18 by axially spaced seals and latched to the set anchor in a manner similar to the seals 166 and the latch 122 discussed below for the sealing nipple.

Figure 3A:
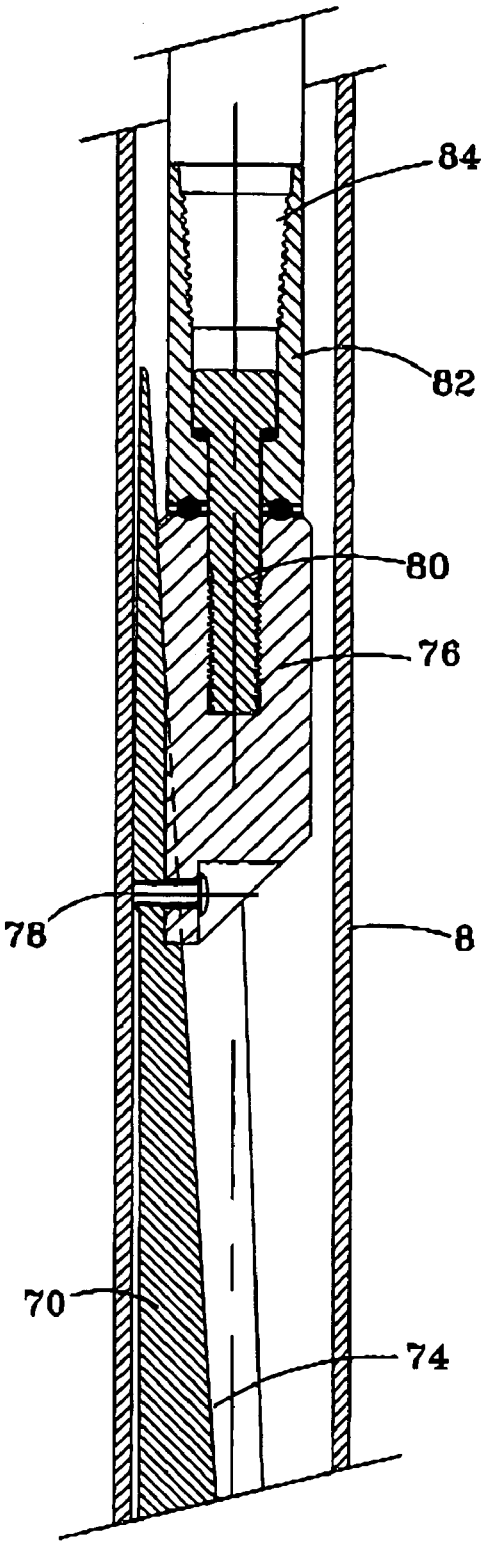
FIG. 3A is a cross sectional view of an upper portion of a whipstock.

FIG. 3A shows the upper portion of whipstock 70, which may be run in the well from a tubular string (not shown) connected to coupling 82 by threads 84. Stud 80 is positioned within a lower cavity in the coupling 82, and may be threaded to block 76, which in turn may be splined or dovetail connected and pinned to the body 70 of the whipstock by pin 78. Whipstock 70 may be a conventional whipstock body with a concave trough forming a whipstock face 74 which acts to divert a tool to mill a hole in the side of the casing string and thereafter divert tools into the hole. As used however, a "tool" diverted by a whipstock face includes a tubular diverted by the whipstock into the hole.

Figure 3B:
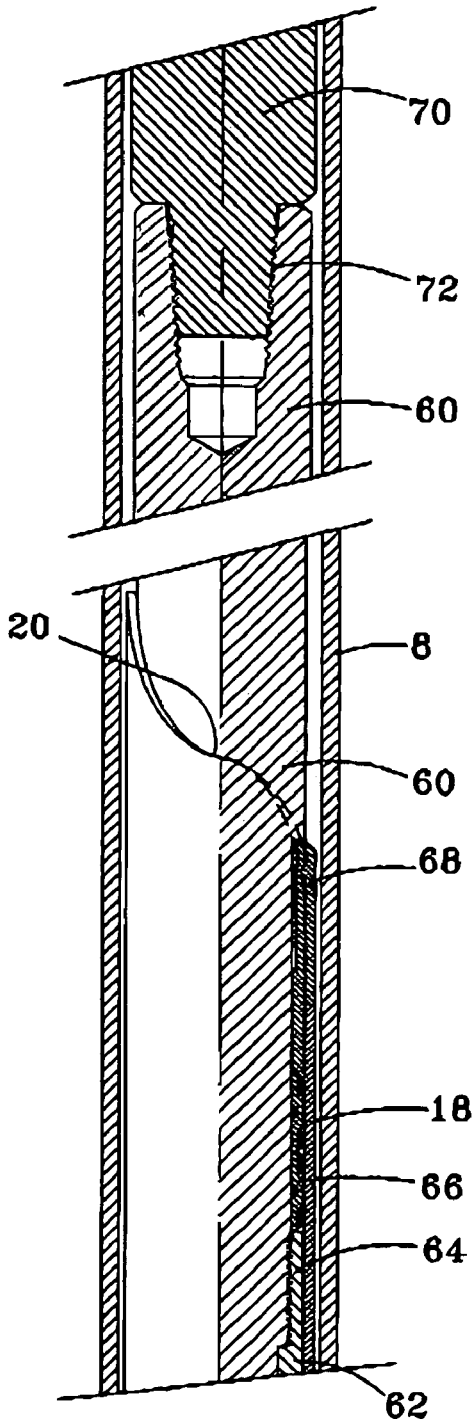
FIG. 3B illustrates a lower portion of the whipstock landed within the expanded anchor.

FIG. 3B shows a lower portion of the whipstock 70, which is connected at 72 to a lower whipstock anchor latch mandrel 60, which in turn extends into the interior of the orientation sleeve 18. The lower sleeve 62 is threaded at 64 to the end of whipstock anchor latch mandrel 60, and extends downward past the set anchor. The sleeve 62 lands on the shoulder 22 of the tubular expander, which is shown in FIG. 1A. A seal body 66 is sandwiched between the upper end of lower sleeve 62 and guide piece 68, which is secured to the whipstock mandrel 60. The guide piece 68 engages the orientation surface 20, and is rotated to fall within a guide slot at the upper end of the orientation sleeve. An outer portion of the guide piece 68 may rest on the bottom of the guide slot in the orientation sleeve. The portion above the break line is shown in full cross section, while the portion below the break line is shown in half section. The lower sleeve 62 and the latch components beneath the set anchor for the whipstock may be substantially the same as the latch components shown in FIG. 4B.

Figure 4A:
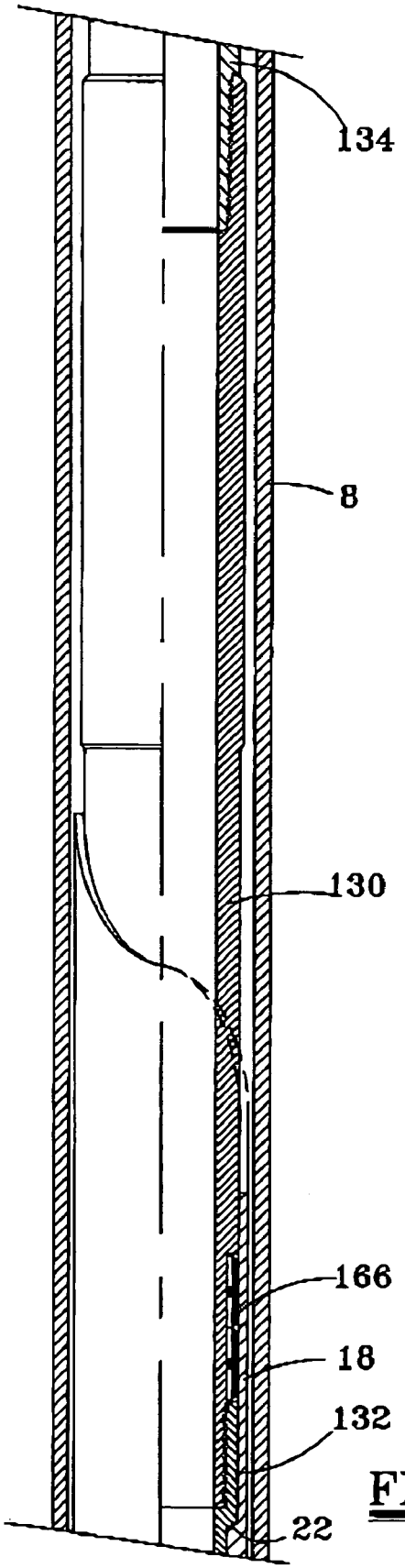
FIG. 4A illustrates a sealing nipple on a lower end of a production tubing string landed in the orientation sleeve after the whipstock has been removed.
Figure 4B:
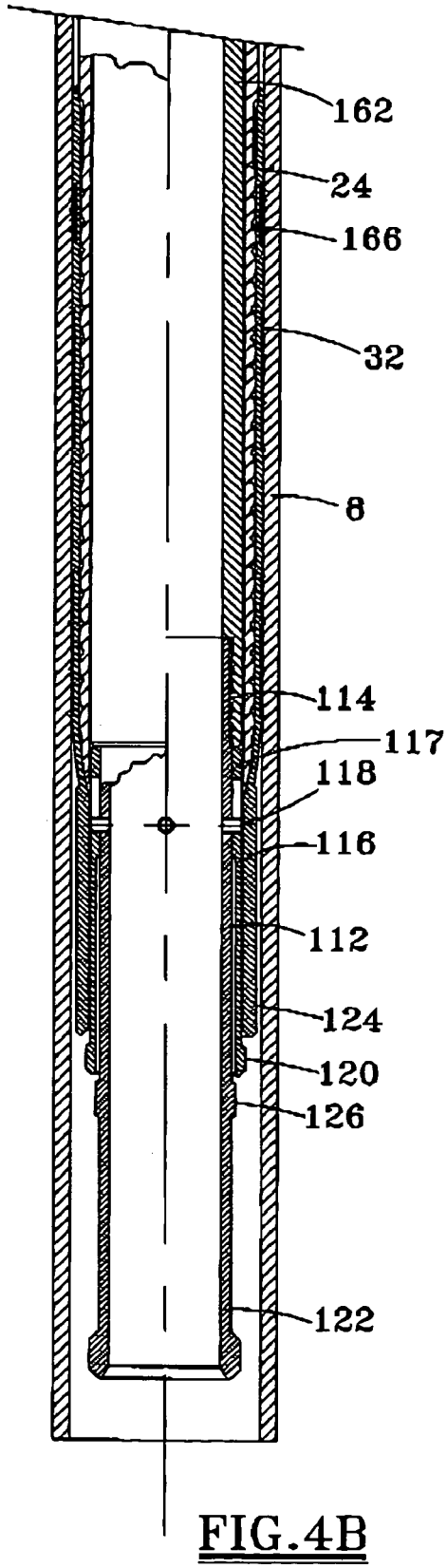
FIG. 4B shows components of the completion seal assembly below the set anchor.

FIG. 4A illustrates a lower end of a production tubing string 134, which is threadably connected to a conventional seal nipple 130, which may be inserted into the orientation sleeve after removal of the whipstock components. Seal assembly 166 may seal between the seal nipple 130 and the interior surface in the orientation sleeve 18. A lower end of the seal nipple 130 may be connected by threads 132 to lower sleeve 162, which extends downward to the lower end of the set anchor 32. Sleeve 162 engages shoulder 22 on the tubular expander 24, thereby limiting downward movement of sleeve 162. Sleeve 122 is threaded at 114 to sleeve 162, and carries pins 118, which move within slots in collect ring 117, with fingers 116 terminating at lower heads 120. The collect finger heads 120 engage the lower end of anchor body 124, which is not radially expanded, to limit upward movement of the seal nipple 130. Enlarged section 126 on sleeve 122 thus pushes the collect heads 120 outward to engage anchor body 124. The latch mechanism as shown in FIG. 4B allows the block 76 to be released from whipstock 70 once the whipstock is set in the well. To retrieve the seal nipple or to retrieve the whipstock body 70, an upward force is applied to shear pins 118, thereby allowing the collect fingers 116 to drop to an unsupported position below enlarged section 126.

A seal nipple may thus be inserted into the upper orientation sleeve 32 of the tubular expander 34. The lower end of the seal nipple may engage the shoulder 22 on the expander 24 when the sealing nipple is fully inserted into the expander. The orientation sleeve 32 of the tubular expander may be an upwardly extending sleeve which is preferably integral with the upper end of expander 24 for sealing with the seal nipple. The orientation sleeve preferably has a polished cylindrical inner surface 19 (see FIG. 2A) for sealing with a cylindrical outer surface of the seal nipple. Alternatively, the orientation sleeve could have a polished cylindrical outer surface for sealing with a cylindrical inner surface of the seal nipple. The seal nipple may also include an elastomeric seal, such as a Chevron seal stack 166, for sealing with the cylindrical inner surface of the sealing sleeve. A seal nipple may also be furnished with one or more external metal-to-metal ball seals for metal-to-metal sealing engagement with inner surface of sealing sleeve.

It is a feature of the invention that the sealing sleeve and the seal nipple form an expansion joint that allows for thermal expansion and contraction of the tubular string above the seal nipple. A related feature of the invention is that the tubular anchor, the expander, the seal nipple and sealing sleeve at the upper end of the tubular expander may function as a big bore production packer. The internal diameter of the sealing nipple and the tubular above the sealing nipple may thus be substantially the same as the internal diameter of the tubular expander radially within the tubular anchor.

The assembly thus provides substantially full bore capability when the whipstock is removed from the anchor. This feature is particularly important since tools which may subsequently be inserted into the well and down past the anchor will not likely get hung up on the anchor or expander due to the full bore feature of the invention.

The whipstock assembly of the present invention provides a highly reliable downhole tool with few moving parts, and particularly parts associated with the anchor. The whipstock assembly anchor is forced under high forces by the tubular expander into engagement with the casing string, and is unlikely to break loose from the casing string when high forces are transmitted to the whipstock. The whipstock anchor is intended to be a permanent anchor in the well, and may serve as an anchor for receiving the sealing nipple of a production tubing string extending upward from the anchor to the surface after the whipstock has been retrieved to the surface.

While preferred embodiments of the present invention have been illustrated in detail, it is apparent that other modifications and adaptations of the preferred embodiments will occur to those skilled in the art. The embodiments shown and described are thus exemplary, and various other modifications to the preferred embodiments may be made which are within the spirit of the invention. Accordingly, it is to be expressly understood that such modifications and adaptations are within the scope of the present invention, which is defined in the following claims.

The invention claimed is:

1. A whipstock assembly for use downhole in a wellbore to mill a hole or to divert a tool into the hole in a side of a casing string, the whipstock assembly comprising:

a tubular anchor removably supportable on a running tool for positioning the tubular anchor downhole, the tubular anchor having an initial anchor inner diameter, and having an initial anchor outer diameter less than an inner diameter of the casing string, the tubular anchor being expandable by the running tool to seal with the casing string;

a tubular expander removably supportable on the running tool, the tubular expander having an expander outermost diameter greater than the initial anchor inner diameter;

the running tool including an actuator for forcibly moving the tubular expander axially from a position substantially axially spaced from the tubular anchor to a position substantially within the tubular anchor, thereby radially expanding the tubular anchor against the casing string to secure the tubular expander and the tubular anchor downhole; and a whipstock engageable with the tubular expander for orienting a whipstock face for milling the hole or diverting the tool into the hole in the side of the casing string.

2. A whipstock assembly as defined in claim 1, further comprising:

an orientation sleeve secured to an upper end of the tubular expander and having an upper orientation surface for engagement with the whipstock to orient the whipstock to a desired azimuth.

3. A whipstock assembly as defined in claim 2, wherein the whipstock is removable from the orientation sleeve.

4. A whipstock assembly as defined in claim 2, wherein the orientation sleeve includes a polished cylindrical surface for sealing with one or more of the whipstock and a tubular string extending upward from the orientation sleeve after the whipstock is removed from the orientation sleeve.

5. A whipstock assembly as defined in claim 1, wherein a lower end of the running tool engages the tubular anchor to restrict axial movement of the tubular anchor when moving the tubular expander axially into the tubular anchor.

6. A whipstock assembly as defined in claim 1, wherein the tubular expander is sealed to the tubular anchor by a plurality of annular bumps on an outer surface of the tubular expander.

7. A whipstock assembly as defined in claim 1, wherein:

the tubular expander has a generally cylindrical exterior surface along substantially an axial length of the tubular expander, such that the tubular anchor is expanded substantially the same amount along the axial length of the tubular expander.

8. A whipstock assembly as defined in claim 1, wherein a stop on the tubular anchor limits axial movement of the tubular expander with respect to the tubular anchor.

9. A whipstock assembly as defined in claim 1, further comprising:

one or more packer seals on the tubular anchor for sealing with the casing string upon expansion of the tubular anchor.

10. A whipstock assembly as defined in claim 1, further comprising:

a plurality of slips fixed on the tubular anchor for securing the tubular anchor to the casing string when the tubular anchor is expanded by the tubular expander.

11. A whipstock assembly for use downhole in a wellbore to mill a hole or divert a tool into the hole in a side of the casing string, the whipstock assembly comprising:

a tubular anchor removably supportable on a running tool for positioning the tubular anchor downhole, the tubular anchor having an initial anchor inner diameter, and having an initial anchor outer diameter less than an inner diameter of the casing string, the tubular anchor being expandable by the running tool to seal with the casing string;

a tubular expander removably supportable on the running tool, the tubular expander having an expander outermost diameter greater than the initial anchor inner diameters, the tubular expander having a generally cylindrical exterior surface along substantially an axial length of the tubular expander, such that the tubular anchor is expanded substantially the same amount along the axial length of the tubular expander;

the running tool including an actuator for forcibly moving the tubular expander axially from a position substantially axially spaced from the tubular anchor to a position substantially within the tubular anchor, thereby radially expanding the tubular anchor against the casing string to secure the tubular expander and the tubular anchor downhole;

an orientation sleeve secured to an upper end of the tubular expander and having an upper orientation surface for engagement with the whipstock; and a whipstock engageable with the upper orientation surface for orienting a whipstock face to mill the hole or divert the tool into the hole in the side of the casing string.

12. A whipstock assembly as defined in claim 11, wherein the whipstock is removable from the orientation sleeve.

13. A whipstock assembly as defined in claim 11, wherein the lower end of the running tool engages the tubular anchor to restrict axial movement of the tubular anchor when moving the tubular expander axially into the tubular anchor.

14. A whipstock assembly as defined in claim 11, wherein the tubular expander is sealed to the tubular anchor by a plurality of annular bumps on an outer surface of the tubular expander.

15. A whipstock assembly as defined in claim 11, further comprising:

one or more packer seals on the tubular anchor for sealing with the casing string upon expansion of the tubular anchor; and a plurality of slips fixed on the tubular anchor for securing the tubular anchor to the casing string when the tubular anchor is expanded by the tubular expander.

16. A method of setting a whipstock assembly downhole in a wellbore to seal with a casing string and mill a hole or divert a tool into the hole in a side of the casing string, the method comprising:

removably supporting a tubular anchor on a running tool for positioning the tubular anchor downhole, the tubular anchor having an initial anchor inner diameter, and having an initial anchor outer diameter less than an inner diameter of the casing string, the tubular anchor being expandable by the running tool to seal with the casing string;

removably supporting a tubular expander on the running tool, the tubular expander having an expander outermost diameter greater than the initial anchor inner diameter;

forcibly moving the tubular expander axially from a position substantially axially spaced from the tubular anchor to a position substantially within the tubular anchor, thereby radially expanding the tubular anchor against the casing string to secure the tubular expander and the tubular anchor downhole; and engaging a whipstock with the tubular expander for orienting a whipstock face for milling the hole or for diverting the tool into the hole in the side of the casing string.

17. A method as defined in claim 16, further comprising:

securing an orientation sleeve to an upper end of the tubular expander and having an upper orientation surface for engagement with the whipstock.

18. A method as defined in claim 16, further comprising:

sealing the tubular anchor to the tubular anchor by a plurality of annular bumps on an outer surface of the tubular expander.

19. A method as defined in claim 16, further comprising:

limiting axial movement of the tubular expander with respect to the tubular anchor by a stop.

20. A method as defined in claim 16, further comprising:

sealing one or more packer seals on the tubular anchor with the casing string upon expansion of the tubular anchor; and securing the tubular anchor to the casing string with a plurality of slips fixed on the tubular anchor when the tubular anchor is expanded by the tubular expander.

21. A method as defined in claim 16, further comprising:

removing the whipstock from the tubular expander; and thereafter sealing a production tubing string with the tubular expander.

* * * * *